US005422153A

United States Patent [19]

Miyamoto

[11] Patent Number: 5,422,153

[45] Date of Patent: Jun. 6, 1995

[54] WEFT KNITTED COMPOSITE FABRIC

[75] Inventor: Eiji Miyamoto, Kanazawa, Japan

[73] Assignee: Marumiya Shoko Co., Ltd., Toyama, Japan

[21] Appl. No.: 264,370

[22] Filed: Jun. 23, 1994

[30] Foreign Application Priority Data

Jun. 25, 1993 [JP] Japan ..... 5-179987
Nov. 11, 1993 [JP] Japan ..... 5-305887

[51] Int. Cl.[6] ..... B32B 3/02

[52] U.S. Cl. ..... 428/95; 66/194; 66/196; 66/198; 66/202; 428/85; 428/116; 428/253

[58] Field of Search ..... 66/194, 196, 198, 202; 428/116, 85, 95, 253

[56] References Cited

FOREIGN PATENT DOCUMENTS 2-74648 3/1990 Japan .
2-31144 7/1990 Japan .
2-229247 9/1990 Japan .

*Primary Examiner*—James J. Bell
*Attorney, Agent, or Firm*—Oliff & Berridge

[57] ABSTRACT

A weft knitted composite fabric comprises a frontal layer of a weft knitted fabric, a rear layer of a weft knitted fabric and binding yarns. Said rear layer of the weft knitted fabric is bound with said frontal layer by weave of said binding yarns and arranged with a given distance separating the frontal layer and the rear layer. Said binding yarns are more stiff than knitting yarns of said frontal layer and said rear layer. Said binding yarns comprise S-twist yarns and Z-twist yarns alternately. Said frontal layer of a weft knitted fabric may include knitting yarns for pile so that a surface of said frontal layer is provided with a pile.

5 Claims, 3 Drawing Sheets

WEFT KNITTED COMPOSITE FABRIC

BACKGROUND OF THE INVENTION

This invention relates to a weft knitted composite fabric comprising two fabric layers for material for decorating both the interior and the exterior of buildings, cars, furniture, bags or the like.

Cushioning material of sheets of PVC spongy has been popularly used for decorating the interior and the exterior of buildings, cars, furniture and bags. Such material is not recyclable and hence can give rise to environmental problems. In order to prevent the environmental problems, there was proposed a Raschel fabric of a warp knitted composite fabric. However, it not satisfactorily expandable in a weft direction so as not to provide a good cushioning property. Also, such Raschel fabric is costly. In addition, if a raising finish is applied, it will become even more costly and hence less acceptable as an alternative to the PVC spongy.

SUMMARY OF THE INVENTION

It is therefore an object of the present invention to provide at relatively low cost a weft knitted fabric made of recyclable yarns and having a satisfactory expandability in warp and weft direction so as to provide a good cushioning property so that it may be suitably used as an interior or exterior material in a variety of applications. In addition, an another object of the present invention is to provide a weft knitted fabric having a good touch by a pile provided thereon.

According to the first aspect of the invention, the above object and other objects of the invention are achieved by providing a weft knitted composite fabric comprising a frontal layer of a weft knitted fabric, a rear layer of a weft knitted fabric and binding yarns, said rear layer of the weft knitted fabric being bound with said frontal layer by weave of said binding yarns and arranged with a given distance separating the frontal layer and the rear layer, said binding yarns being more stiff than knitting yarns of said frontal layer and said rear layer, and said binding yarns comprising S-twist yarns and Z-twist yarns alternately.

According to the second aspect of the invention, it is provided a weft knitted composite fabric comprising a frontal layer of a weft knitted fabric, a rear layer of a weft knitted fabric and binding yarns, said rear layer of the weft knitted fabric being bound with said frontal layer by weave of said binding yarns and arranged with a given distance separating the frontal layer and the rear layer, said binding yarns being more stiff than knitting yarns of said frontal layer and said rear layer, said binding yarns comprising S-twist yarns and Z-twist yarns alternately, and said frontal layer of a weft knitted fabric comprising knitting yarns and knitting yarns for pile so that a surface of said frontal layer is provided with a pile.

According to the present invention, since the frontal layer and the rear layer are bound together by a weave of binding yarns which are more stiff than knitting yarns of said frontal layer and said rear layer, and since the binding yarns comprise S-twist yarns and Z-twist yarns arranged alternately, the frontal layer and the rear layer are positioned with the distance corresponding to a length of the binding yarns between the layers. In addition, oppositely directed torques of the binding yarns generated by the oppositely twisted yarns maintains the weave of binding yarns to maintain the distance between the frontal and rear layers, even if the weft knitted fabric is pressed repeatedly. Thus, the weft knitted fabric according to the present invention has a good cushioning property.

Additionally, the present invention shows a satisfactory expandability both in the warp and weft (longitudinal and the lateral) directions.

A weft knitted composite fabric according to the invention is recyclable and hence friendly to the environment if it is made of polyester yarns which can be recyclable.

The thickness, cushioning property and other properties of a weft knitted composite fabric according to the invention can be modified by controlling the stiffness and the length of the binding yarn between the frontal layer and the rear layer and selecting the number of binding yarns per unit area of the composite fabric. In addition, the weft knitted composite fabric can be widely subjected to many processing such as dying process, laminating process, bonding process so as to broaden the scope of application of the weft knitted fabric.

According to the second aspect of the invention, since a pile is formed on the surface of the frontal layer of a weft knitted composite fabric according to the invention, it has an excellent appearance and an agreeable touch and can be processed to provide a variety of different appearances and touches by raising and/or shirring.

It should be noted that a weave of a weft knitted composite fabric according to the invention is not limited to the weave illustrated in the attached drawings. Any weave having a weave of weft knitted composite fabric can be used in the present invention. If the material of the binding yarn and the knitting yarn is friendly to the environment, such material can be used in the present invention, although polyester is recommendable from the view point of recycling.

DESCRIPTION OF THE PREFERRED EMBODIMENTS

Figure 1:
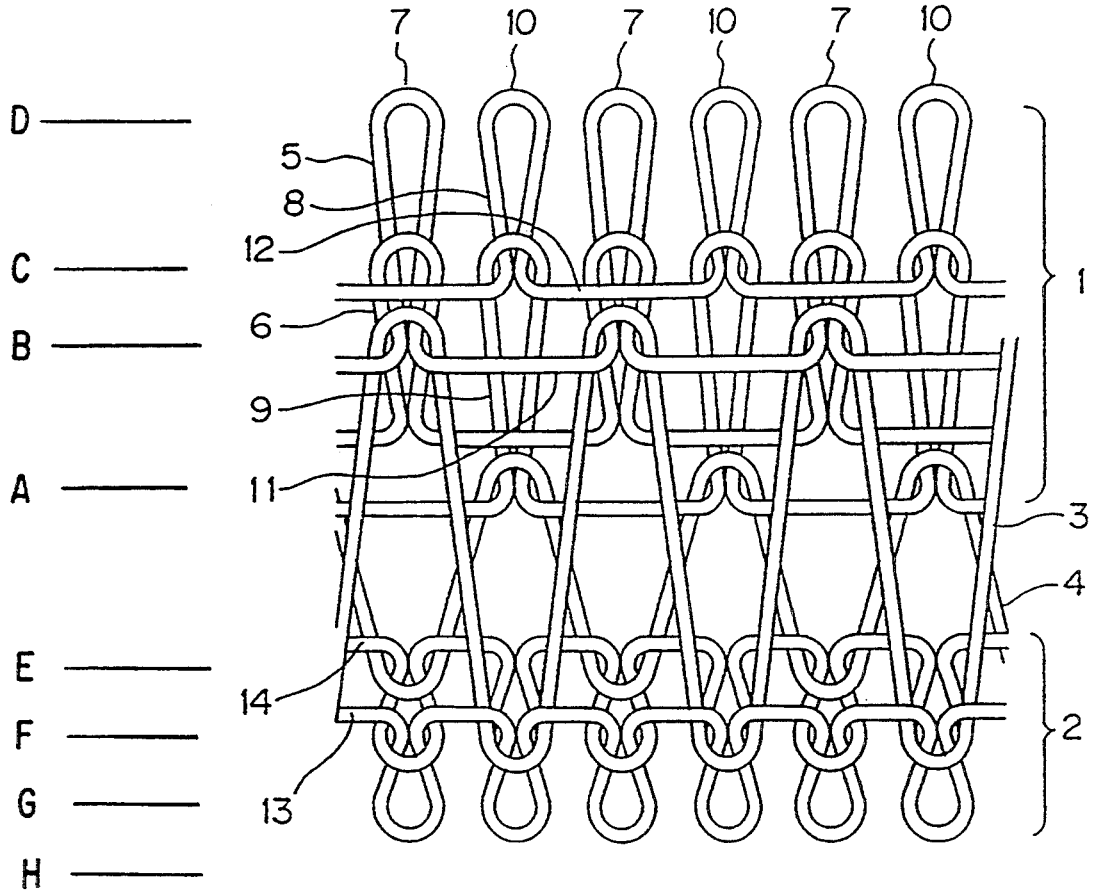
FIG. 1 is an enlarged schematic partial view of a first embodiment of a weft knitted composite fabric according to the invention, and illustrates the weave.
Figure 2:
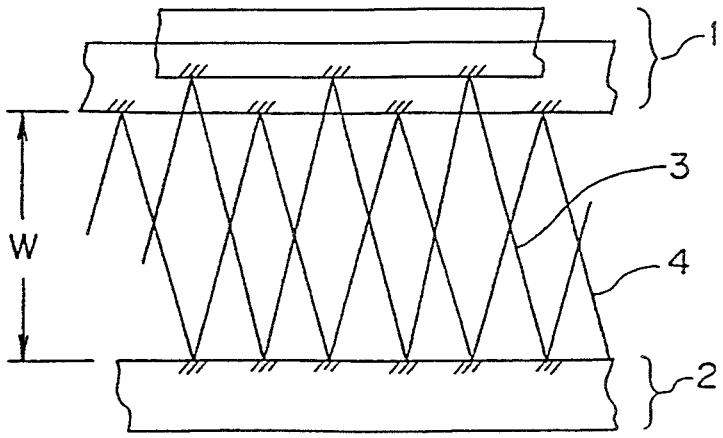
FIG. 2 is an enlarged schematic partial sectional view of the embodiment of FIG. 1 as seen from a lateral side of FIG. 1.

FIGS. 1 and 2 illustrate a first embodiment of the present invention. The weft knitted composite fabric according to the present invention comprises a frontal layer 1 of a weft knitted fabric and a rear layer 2 of a weft knitted fabric. These layers 1 and 2 are bound by binding yarns with a distance W separating them from each other, Said binding yarns include S-twist binding yarns 3 and Z-twist binding yarns 4 arranged alternately.

Although FIG. 1 is illustrated in order to clarify the construction of the knitting so that the frontal layer 1, the rear layer 2 and the binding yarns 3 and 4 may appear to be laid on a same plane in FIG. 1, it should be understood that the weft knitted fabric of the rear layer 2 is arranged below the frontal layer 1 in parallel with a distance W separating them from each other and is bound with the frontal layer 1 by binding yarns 3 and 4, as seen from FIG. 2.

Stop-course of the weft knitted fabrics 1 and 2 are not shown in FIG. 1.

In the weft knitted fabric 1 of the frontal layer of the embodiment illustrated in FIGS. 1 and 2, there are wales 7 formed by knitting yarns 5 and 6 and wales 10 formed by knitting yarns 8 and 9. Said wales 7 and 10 are alternatively arranged. In the preferred embodiment, the knitting yarns 5, 6, 8, and 9 are made of polyesters. A weave of the knitting yarns 5 and 6 is bound with a weave of the knitting yarns 8 and 9 by crossing sinker loops 11, 12 and wales 7, 10.

The weft knitted fabric 2 of the rear layer of the illustrated embodiment comprises a weave of knitting yarns 13 and 14. In the preferred embodiment, material of the knitting yarns 13 and 14 is same as that of the knitting yarns 5, 6, 8 and 9 and is made of polyesters.

The frontal layer 1 and the rear layer 2 of weft knitted fabric are bound together by binding yarns 3 and 4 as described above. The binding yarns 3 and 4 are more stiff than the knitting yarns 5, 6, 8, 9, 13 and 14, and are made of polyesters. As described above, the binding yarns 3 are S-twist yarns and the binding yarns 4 are Z-twist yarns.

In the illustrated embodiment, the binding yarns 3 and 4 are knitted with the sinker loop at every other wales and at every other courses (or alternate courses). In other words, the binding yarn 3 is knitted with the sinker loop 11 at a course B and at a wale 7. Then, the binding yarn 3 is knitted with the sinker loop at a course F and at a wale 10. These are repeated. When the knitting is processed, the binding yarn 3 is knitted with the sinker loop (not shown) at a course D and then at a course H. The binding yarn 4 is knitted with the sinker loop at a wale 10 and at a course adjacent to the course at which the binding yarn 3 is knitted with the sinker loop 11. Then, the binding yarn 4 is knitted with the sinker loop at a wale 7 at a course E. These are repeated. When the knitting is processed, the binding yarn 4 is knitted with the sinker loop (not shown) at a course C and then at a course G. However, the present invention is not limited to the weave illustrated in the drawings. If the binding yarns are knitted with the sinker loop at alternate wales and at alternate courses, such weave is applicable to the present invention.

Figure 3:
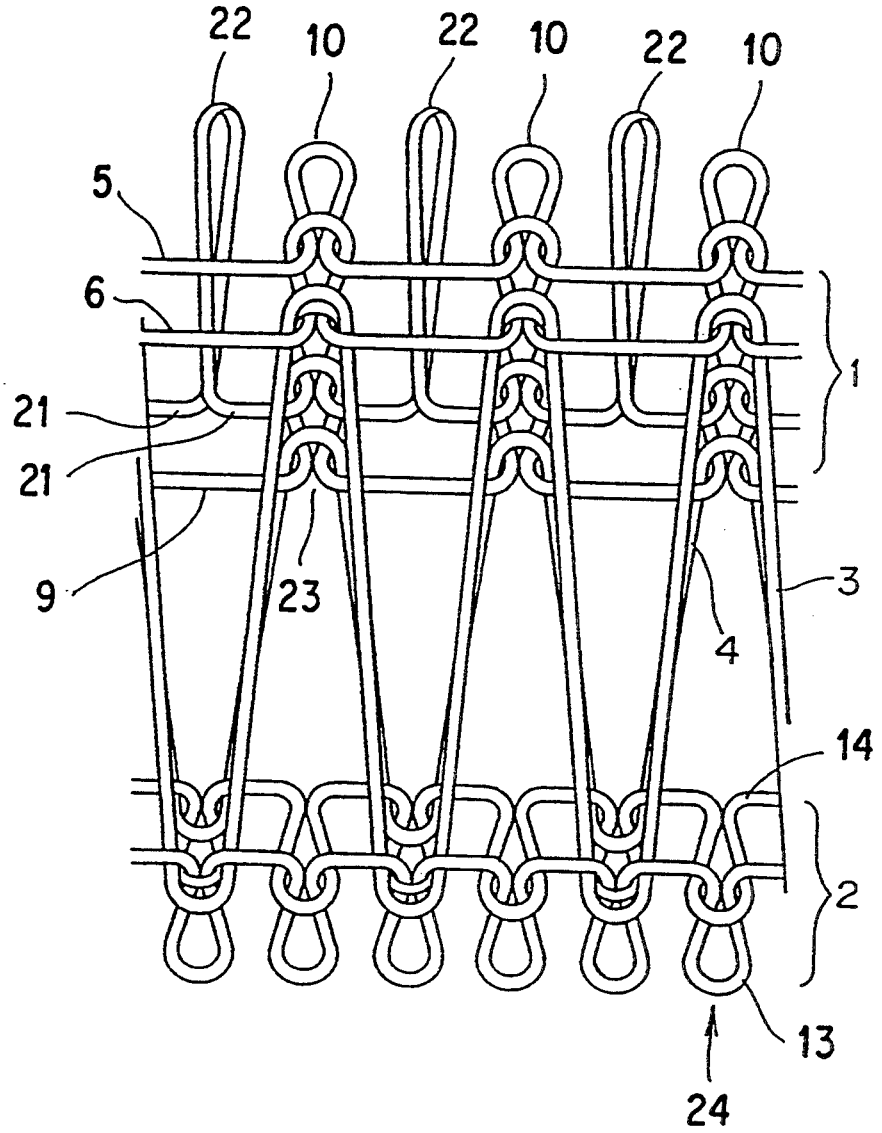
FIG. 3 is an enlarged schematic partial view of a second embodiment of weft knitted composite fabric according to the invention, and illustrates the weave.
Figure 4:
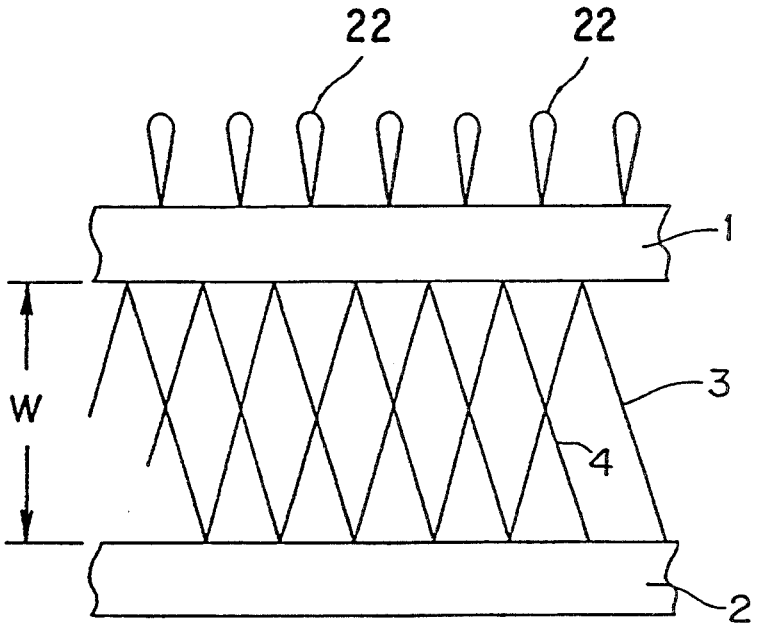
FIG. 4 is an enlarged schematic partial sectional view of the second embodiment of FIG. 3 as seen from a lateral side of FIG. 3.

FIGS. 3 and 4 illustrate the second embodiment of the present invention.

In the second embodiment, the weft knitted fabric of the frontal layer 1 contains knitting yarns 21 for pile to produce a loop pile 22 on a surface of the frontal layer 1.

In the frontal layer 1 of the illustrated embodiment, a wale 10 of the frontal layer 1 is formed by a stitch of a knitting yarn 5 and a knitting yarn 6. In the preferred embodiment, the knitting yarns 5 and 6 are made of polyester. Such wale 10 is continued to a wale 23 formed by the knitting yarn 21 for pile and a knitting yarn 9 so as to form a continuous wale 10 of the wale 10 and the wale 23. The knitting yarn 9 is made of a material same as that of the knitting yarns 5, 6. The loop pile 22 is formed between the continuous wale 10 and the adjacent continuous wale 10. Preferably, the knitting yarns 21 for pile are made of polyesters.

The pile 22 is subjected to raising and/or shirring to form the weft knitted composite fabric with a nap. If filaments of pile are densely arranged, the fabric produced by the above-identified method can be used as the weft knitted composite fabric without requiring a raising and/or shirring process. If filaments of pile are densely arranged. If such is the case, a cushioning property of the weft knitted composite fabric is increased.

What is claimed is:

1. A weft knitted composite fabric comprising a frontal layer of a weft knitted fabric, a rear layer of a weft knitted fabric and binding yarns, said rear layer of the weft knitted fabric being bound with said frontal layer by weave of said binding yarns and arranged with a given distance separating the frontal layer and the rear layer, said binding yarns being more stiff than knitting yarns of said frontal layer and said rear layer, and said binding yarns comprising S-twist yarns and Z-twist yarns alternately.

2. The weft knitted composite fabric according to the claim 1, wherein said knitting yarns are made of polyesters.

3. The weft knitted composite fabric according to the claim 1, wherein said binding yarns are made of polyesters and are more stiff than said knitting yarns.

4. A weft knitted composite fabric comprising a frontal layer of a weft knitted fabric, a rear layer of a weft knitted fabric and binding yarns, said rear layer of the weft knitted fabric being bound with said frontal layer by weave of said binding yarns and arranged with a given distance separating the frontal layer and the rear layer, said binding yarns being more stiff than knitting yarns of said frontal layer and said rear layer, said binding yarns comprising S-twist yarns and Z-twist yarns alternately, and said frontal layer of a weft knitted fabric comprising knitting yarns and knitting yarns for pile so that a surface of said frontal layer is provided with a pile.

5. A cushioning material including the weft knitted composite fabric according to the claim 1.

* * * * *